US008453724B2

(12) United States Patent
Zhou

(10) Patent No.: US 8,453,724 B2
(45) Date of Patent: Jun. 4, 2013

(54) TOOL FOR RECOVERING JUNK AND DEBRIS FROM A WELLBORE OF A WELL

(75) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 320 days.

(21) Appl. No.: 12/927,325

(22) Filed: Nov. 12, 2010

(65) Prior Publication Data

US 2012/0118571 A1 May 17, 2012

(51) Int. Cl.
*E21B 31/08* (2006.01)

(52) U.S. Cl.
USPC ..... 166/99; 166/301

(58) Field of Classification Search
USPC ..... 166/301, 99
See application file for complete search history.

(56) References Cited

U.S. PATENT DOCUMENTS

| | | | | |
|---|---|---|---|---|
| 2,700,567 | A | | 1/1955 | Fortenberry |
| 2,830,663 | A | | 4/1958 | Kirby, II |
| 2,830,664 | A | | 4/1958 | Kirby, II |
| 2,915,127 | A | | 12/1959 | O'Farrel Abendroth |
| 2,918,323 | A | | 12/1959 | Coffee |
| 3,023,810 | A | | 3/1962 | Anderson |
| 3,120,872 | A | * | 2/1964 | Anderson ..... 166/99 |
| 3,203,491 | A | | 8/1965 | Turley |
| 3,382,925 | A | | 5/1968 | Jennings |
| 4,059,155 | A | | 11/1977 | Greer |
| 4,084,636 | A | | 4/1978 | Burge |
| 4,276,931 | A | | 7/1981 | Murray |
| 4,296,822 | A | | 10/1981 | Ormsby |
| 4,603,739 | A | | 8/1986 | Krugh |
| 4,711,299 | A | | 12/1987 | Caldwell et al. |
| 5,176,208 | A | | 1/1993 | Lalande et al. |
| 5,402,850 | A | | 4/1995 | Lalande et al. |

(Continued)

FOREIGN PATENT DOCUMENTS

| | | |
|---|---|---|
| GB | 2 354 542 | 3/2001 |
| SU | 623955 | 9/1978 |
| SU | 1182153 | 9/1985 |
| SU | 1209824 | 2/1986 |

OTHER PUBLICATIONS

International Search Report and Written Opinion of the International Searching Authority completed Mar. 15, 2012 and mailed Mar. 23, 2012 by the International Searching Authority of the United States Receiving Office, in counterpart application No. PCT/US2011/059952.

(Continued)

*Primary Examiner* — William P Neuder
(74) *Attorney, Agent, or Firm* — Abelman, Frayne & Schwab

(57) ABSTRACT

A downhole tool incorporates a junk catcher with full body casing drift. It is made of an inner tubular member that conveys the hydraulic power or circulating fluid to rearward and outward facing jet nozzles for directly flushing downhole junks in front of the tool (if encountered) into a junk collecting barrel equipped with individual magnets to retain magnetically attractive metal junks. The barrel is made of high grade steel material with outer diameter matching the full drift of wellbore casing. The front, or the lower end of the outer body is addressed with tungsten carbide cutters to effectively handle metal junks in case of milling action is required. The back, or upper end of the barrel has return flow ports equipped with a filter screen to retain small, medium and large size junks while fluid is pumped through the tool.

28 Claims, 6 Drawing Sheets

U.S. PATENT DOCUMENTS

| | | | | |
|---|---|---|---|---|
| 5,628,366 | A | 5/1997 | Telfer | |
| 5,682,950 | A | 11/1997 | Bjornstad | |
| 5,950,742 | A | 9/1999 | Caraway | |
| 6,176,311 | B1 | 1/2001 | Ryan | |
| 6,250,387 | B1 | 6/2001 | Carmichael et al. | |
| 6,276,452 | B1 | 8/2001 | Davis et al. | |
| 6,453,996 | B1 | 9/2002 | Carmichael et al. | |
| 6,640,904 | B2 | 11/2003 | Hoffman et al. | |
| 6,951,251 | B2 | 10/2005 | Penisson | |
| 7,188,675 | B2 | 3/2007 | Reynolds | |
| 7,497,260 | B2 | 3/2009 | Telfer | |
| 7,610,957 | B2 | 11/2009 | Davis et al. | |
| 7,753,124 | B1 * | 7/2010 | Penisson | 166/311 |
| 2002/0053428 | A1 | 5/2002 | Maples | |
| 2006/0071474 | A1 | 4/2006 | Hallett et al. | |
| 2009/0126933 | A1 * | 5/2009 | Telfer | 166/301 |
| 2010/0263875 | A1 | 10/2010 | Williams et al. | |

OTHER PUBLICATIONS

International Preliminary Report on Patentability in Chapter II mailed Dec. 4, 2012 by the US Receiving Office (IPEA/US) in PCT/US2011/059952.

* cited by examiner

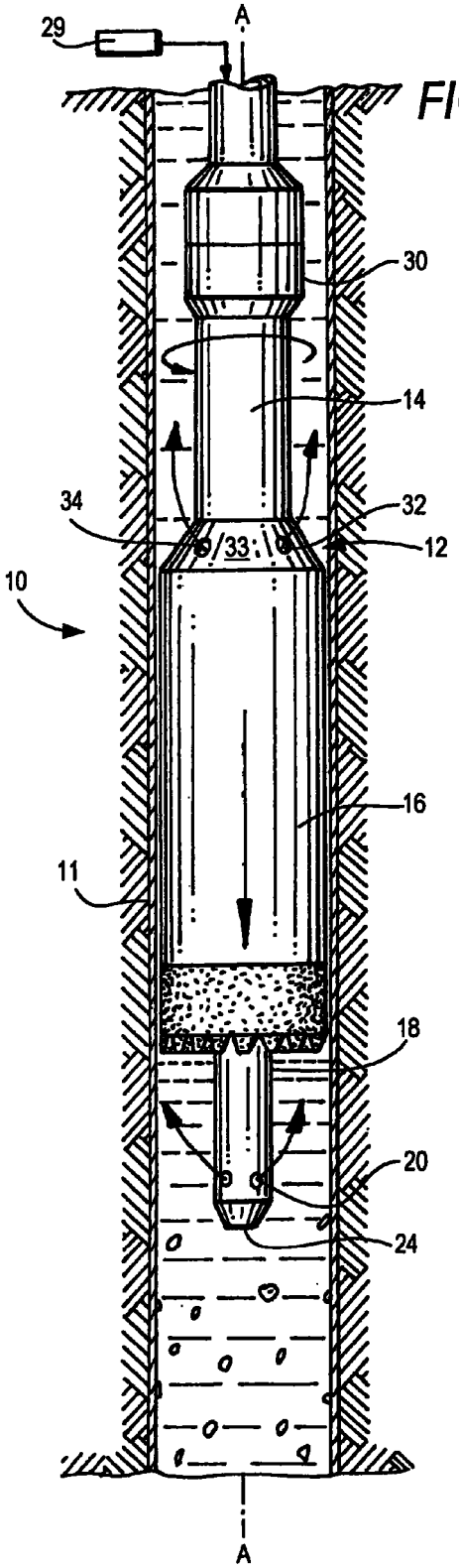
FIG. 1
FIG. 2
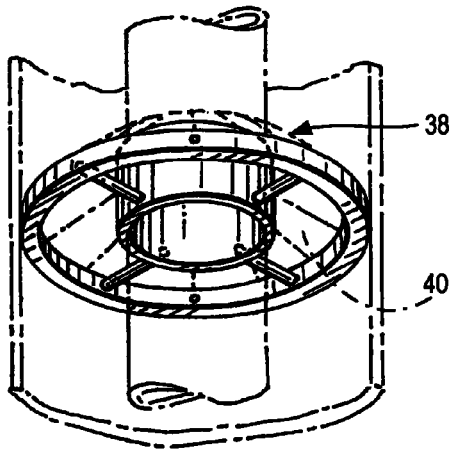
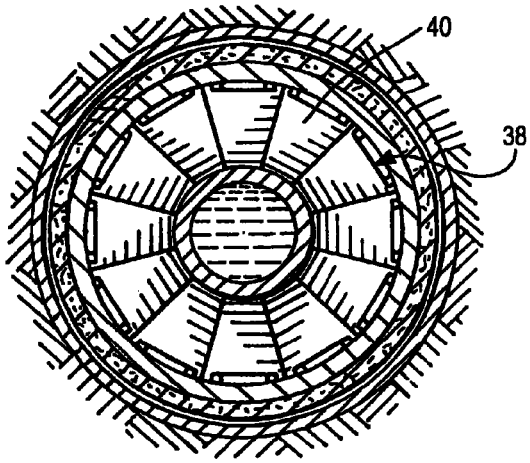
FIG. 5

TOOL FOR RECOVERING JUNK AND DEBRIS FROM A WELLBORE OF A WELL

BACKGROUND OF THE INVENTION

1. Field of the Invention

The present invention relates to a tool for recovering debris and other objects from a well, to facilitate cleanout of the well through the wellbore.

2. Description of the Related Art

In drilling a well, a thorough wellbore cleanout operation is generally required prior to installing a solid expandable liner or smart completion. Smart completion generally refers to downhole wellbore completion equipment or tools that are equipped with flow-control devices that can close or partially close a producing interval. Such devices are operated via either hydraulic control lines or electrical control lines from the surface. They are mostly hydraulically operated at the present time in the field.

For any kind of well, the wellbore must be as clean as possible. The very first requirements are that the wellbore will be free of debris or any foreign objects for the purpose of reducing failure risk of running completion, or for reducing potential reservoir damage, or causing blockage to production tubing at the production stage. Therefore it is particularly important to remove downhole objects such as metal, brass, aluminum, cement blocks, pieces of rubber, or debris from production casing. Hereafter, such objects shall be referred to as "Junk", or "Junks".

Packer slips are a set of hanging devices that are usually designed to extend out and bite or indent into the base casing as a result of the packer setting force, so that they carry the weight of the packer together with any attached production tubing string that is below the packer.

Production packer generally refers to a device or downhole tool that separates the producing interval exposed to reservoir fluid from the interval above it by acting as a physical isolation barrier. It usually includes packer slips and packer elements which typically are comprised of an elastomeric band, or in some cases, a band which provides a metal-to-metal surface. The packer element generally provides a pressure seal from above to below the location of the device. The packer element is usually set by shifting a built-in mandrel so that the outer diameter of the element becomes larger and is compressed against the casing wall. The packer element is a means for compartmenting a reservoir. It assists in the efficient production of oil or gas from a well having one or more productive horizons. The function of the packer is to provide a seal between the outside of the tubing and the inside of the casing to prevent movement of fluids past this port. Although the expression "production packer" is sometimes referred to as just "packer", a packer which is not used as a production packer usually does not contain packer slips. Such packers can be deployed below the production packer as an open hole, or cased hole packer, with the purpose of acting as a zonal isolation device.

The heavy junks are typically made of large pieces of packer slips after milling the production packer, or small metal pieces after cutting the window exit, or junks left behind from earlier drilling BHA (i.e., bottom hole assembly). These junks usually fall down or lay on the low side of the hole, and are difficult to circulate out of the hole, in that they generally reside either in highly deviated or horizontal sections of the production casing/liner, or in an open hole below the casing shoe.

Currently there are many types of available downhole tools that can be deployed to perform a junk removal operation, including:

a) core barrel type junk catchers;
b) reverse circulating junk baskets;
c) casing scrappers;
d) casing brushes;
e) string magnets;
f) Well Patroller®;
g) Junk Trapper® by Well Flow International; and
h) Various other systems.

The first two tools mentioned herein are usually used for "fishing" operations in which the "fish" (i.e., junk) may be a lost cone from a tri-cone drill bit, or part of a failed stabilizer or roller reamer, or some other part of the BHA. Such "fish" is typically greater in size than a few inches in diameter. These types of "fishing" tools involve first pushing the "fish" to the bottom of the hole, and then attempting to wash-over or swallow the "fish" by rotating the tool from the surface to cut the formation so that the "fish" is forced into the tool barrel. In the case of using a reverse circulating junk basket, a ball is dropped into the drill string, and it is pumped downwardly, until it lands on its seat inside the tool, so that circulating fluid is diverted out into the annulus between the tool and the formation. The flow then returns via the inner junk basket. The fluid pressure (if any) may help push the "fish" into the basket. On some tools, the front of the basket has a type of catcher device that attempts to keep the big junk closed in. The types of tools described hereinabove are not intended to be effective to catch small to medium size junks or debris.

Some of the tools described hereinabove are typically designed for wellbore cleanout operations that are intended to remove a large amount of small to medium size junks or debris from a cased hole.

Current practice of wellbore cleanout operations often requires multiple trips. However, no assurance is given until a proper drift is conducted to verify that the hole is indeed clean. Also, currently deployed wellbore cleanout BHA is generally less effective, particularly in dirty wellbores.

The commonly used tools such as Well Patroller@ or Junk Trapper® are always designed to be part of wellbore cleanout BHA and are usually spaced out at or near the top of the BHA.

Well Patroller® is a trademark of Specialized Petroleum Services Group Limited Corporation, United Kingdom, for power operated downhole tools used for the drilling of oil and gas. Junk Trapper® is a trademark of Well Flow International for a multi-functional tool used to retrieve a wide assortment of materials left downhole. In general, both tools are downhole filter-type junk or debris collectors which are commonly used in the field.

The effectiveness of the above-mentioned tools has been shown to be very limited from many field experiences, where the junks collected by such tools were often considerably less than that from string magnets, because the very first tool of the BHA was typically a used bit or taper mill that was turned to first encounter the largest of the junks. In such case, the junks were likely to be pushed downhole and even to the open hole below the casing shoe, because the bit or mill is generally not designed to catch such large junks. If the junks passed the bit or taper mill, they could be circulated up some distance and then fall down again during pipe connection time. This may be a particular problem in a high angle cased hole section where it is usually difficult to move junks by circulation alone, specifically with regard to metal junks. As a result, the string magnet often turned to catch some metal junks because of its close proximity, while some of the junks stayed in the wellbore. Some small pieces were trapped in the junk catcher if they were able to travel further up the hole due to hydraulic forces created by a higher than usual pump rate. If it were not possible to establish circulation due to total mud loss environment, then these tools were much less effective to the point of not even being worth operating. This situation may become a challenging task with re-entry workover wells that turn to have many metal junks either left in the hole after milling and retrieving the production packer, or junks left over from a previous drilling operation. Consequently several cleanout runs must usually be performed in order to remove as much of the downhole junks as possible.

The existing wellbore cleanout tools sometimes suffered the dramatic failure of screen or sleeve out body, usually due to a sizable metal junk stuck between the outer body and pre-existing casing. Such condition required the work pipe to be shifted up and down in order to free the tool when it became stuck inside the casing. Eventually the screen or sleeve would fail. In addition, the pressure cup or seal ring made of rubber with a larger outside diameter (i.e., equal to the casing internal diameter or slightly larger than the casing drift) at or near the top of these tools, that is typically designed to divert all return flow through their junk barrels, rarely survived the entire cleanout procedure. This was due in part to severe and prolonged friction forces caused by work string rotation, which led to cup failure.

In the context of the present invention, the expression "work string" refers to a drill pipe string typically, and the wellbore cleanout tools attached at the bottom of the work string. The expression "cup failure" refers to the case where a wellbore cleanout tool that has a rubber device, or "cup" with a slightly larger diameter than the rest of the tool, when the tool is rotated and moving up or down with the work string. The "cup" is acted directly against the casing inner surface as a physical barrier so that the returned fluid (i.e., fluid which is pumping down through the tool) is diverted through the inner chamber of the tool for junk collection. Because of friction and lengthy hours of service, such rubber cup usually fails, wherein it is often broken and sometimes left as junk in the hole.

As a result, more junk may be left in the wellbore, rather than being removed during the wellbore cleanout. Because of this relatively major risk, Well Patroller® or an equivalent tool are rarely run toward the casing shoe, or even close to what may be a dirty hole section where hard metal junks may be present. Consequently this type of wellbore cleanout operation is less effective.

U.S. Pat. No. 3,023,810 discloses a reverse circulating junk retriever. U.S. Pat. No. 4,059,155 relates to a reverse circulating junk catcher with internal magnets to retain metal junks. U.S. Pat. No. 5,682,950 discloses a junk mill combined with a junk collector. U.S. Pat. No. 6,250,387 discloses the principle of currently used well patroller tools made by SPS-AFOS Group Limited, Aberdeenshire, United Kingdom. U.S. Pat. No. 7,497,260 discloses another type of junk removal tool. U.S. Pat. No. 4,296,822 relates to a combination core cutting and retaining tool that can be utilized to retrieve junk from a finished wellbore. U.S. Pat. No. 4,084,636 relates to a junk catcher. U.S. Pat. No. 3,203,491 discloses a junk catcher that utilizes a pressurized fluid that is discharged from downwardly angled outlets in the body of the well. U.S. Patent Publication No. 2009/0126933 relates to a tubular retrieving tool that discharges a pressurized fluid through downwardly declined outlets to flush debris from the annular space surrounding the tool. These patents and publications are incorporated herein by reference and made a part of this disclosure.

I have invented an effective wellbore cleanout tool which avoids the disadvantages of prior art tools, some of which are described hereinabove.

SUMMARY OF THE INVENTION

The present invention was conceived from extensive field experience involving wellbore cleanout operations that were a very critical part of numerous well programs before running an expandable liner and/or smart completion. Some of the operational failures occurring in the past were attributed to poor wellbore cleanout or less than optimized condition, i.e., residual junks still left in hole that consequently either obstructed the smooth running or caused damage to the expandable liner or smart completion equipment.

The invention addresses the specific problems that occur in the fields as described above, providing an effective junk catcher that also functions as a mill, if required. More importantly, this tool incorporates rearward facing jet nozzles that directly flush junks into the junk catcher. The design of the tool enables it to work even in a total mud loss environment due to the fact that catching junks only requires localized flushing action rather than establishing circulation to the surface. All other known similarly functioning tools would not work properly in a total mud loss environment, since they rely on circulating fluid movement to carry junks into the junk barrel.

In addition, the invention incorporates a solid full body tool with its outside diameter matching the casing drift. Because of this feature, the tool is also capable of performing a casing drift, or checking of wellbore cleanness (i.e., free of any obstruction). At the same time, it may easily encounter or "feel" junks in a dirty wellbore. If such condition prevails, the tool is well equipped to catch junks whenever they are present below or at the front end of the tool.

In particular, a wellbore cleanout tool for recovering objects and debris from the cased hole of a highly deviated, or horizontal wellbore, is disclosed. The tool comprises:

a) an elongated generally cylindrical body member which defines an inner space for reception of objects to be recovered from a wellbore of the well, the body member having a generally inwardly tapered outer wall portion at the upper end thereof, the tapered outer wall portion having a plurality of upwardly extending apertures therethrough;

b) an elongated tubular member defining a generally longitudinal axis, the elongated tubular body member being positioned inside the elongated generally cylindrical body member and attached thereto, the elongated tubular member extending below the lower end of the generally cylindrical body member, and having a diameter less than the inner diameter of the generally cylindrical body member so as to define an annular space therebetween, the elongated tubular member having a closed front end, and being adapted to receive pressurized flushing liquid at the rear end, the elongated tubular member further having a plurality of generally upwardly extending apertures adjacent the front closed end and extending through the wall of the elongated tubular member, the apertures being oriented at a generally acute angle relative to the longitudinal axis, the apertures for directing the flushing liquid radially outwardly and rearwardly of the elongated tubular member toward the annular space between the generally cylindrical body member and the inner elongated tubular member, to thereby direct objects and debris from the wellbore into the annular space;

c) a multiple-section gate positioned within the elongated generally cylindrical body member and attached to the inner wall of the generally cylindrical body member adjacent the front end thereof, each section of the gate being spring biased to pivot downwardly toward generally radial positions which blocks the front end of the generally cylindrical body member, each gate section being capable of upward pivotal movement by force provided by the upward movement of the flushing liquid when it exits the apertures in the elongated tubular member and is directed toward the gate in the generally cylindrical body member; and d) means positioned adjacent the apertures in the tapered wall portion at the upper end of the cylindrical body member to filter the upwardly directed liquid to separate debris and other objects therefrom prior to the liquid exiting the cylindrical body member through the apertures in the upper tapered wall portion of the cylindrical body member.

A plurality of magnets are preferably positioned inside the elongated generally cylindrical body member to attract magnetically attractable junks. Preferably the plurality of magnets are attached to the inner surface of the elongated generally cylindrical body member.

The generally cylindrical body member has a standard drill pipe short section with a box connection attached to the rear (or upper) end thereof for attachment to a string of drill pipes. The means to filter the upwardly diverted liquid and junks adjacent the apertures in the tapered wall portion is a screen.

The front end of the elongated tubular body member is a bull nose plug. The front end portion of the elongated generally cylindrical body member comprises fine tungsten carbide cutters on the outer circumferential side, and coarse tungsten cutters on the tip. Each section of the multi-section gate is biased by a spring device (preferably a coil spring) toward a generally radial closed position against the outer surface of the elongated tubular member. Each section of the gate is oriented at a generally acute angle relative to the generally longitudinal axis when in the closed position. Further, the multi-section gate is removably attached by screw-type fasteners as a unitary member to the elongated generally cylindrical body member.

The elongated tubular member is threadedly attached to an inner rear portion of the elongated generally cylindrical body member. Further, the directed apertures in the elongated tubular member comprise jet nozzles dimensioned to increase the velocity of the flushing liquid exiting herefrom.

A method of removing junks or debris from a high angle section of a cased hole of a wellbore utilizing a wellbore cleanout tool for recovering objects and debris from the wellbore operative from a rig is disclosed, the cleanout tool comprising an elongated generally cylindrical body member which defines an inner space for reception of objects to be recovered from a wellbore of the well, the body member having a generally inwardly tapered outer wall portion at the upper end thereof, the tapered outer wall portion having a plurality of upwardly extending apertures extending therethrough, an elongated tubular member defining a generally longitudinal axis. The elongated tubular body member is positioned inside the elongated generally cylindrical body member and attached thereto, and extends below the lower end of the generally cylindrical body member. The elongated tubular member has a diameter less than the inner diameter of the generally cylindrical body member so as to define an annular space therebetween, and a closed front end, and is adapted to receive pressurized flushing liquid at the rear end. The elongated tubular member further has a plurality of generally upwardly extending apertures adjacent the front closed end and extends through the wall of the tubular member, the apertures being oriented at a generally acute angle relative to the longitudinal axis, the apertures for directing the flushing liquid radially outwardly and rearwardly of the elongated tubular member toward the annular space between the generally cylindrical body member and the inner elongated tubular member, to thereby direct objects and debris from the wellbore into the annular space. A multiple-section gate is positioned within the elongated generally cylindrical body member and is attached to the inner wall of the generally cylindrical body member adjacent the front end thereof, each section of the gate being spring biased to pivot downwardly toward generally radial positions which blocks the front end of the generally cylindrical body member, each gate section being capable of upward pivotal movement by force provided by the upward movement of the flushing liquid when it exits the apertures in the elongated tubular member and is directed toward the gate in the generally cylindrical body member. Means is positioned adjacent the apertures in the tapered wall portion at the upper end of the cylindrical body member to filter the upwardly directed liquid to separate debris and other objects therefrom prior to the liquid exiting the cylindrical body member through the apertures in the upper tapered wall portion of the cylindrical body member. The method comprises the steps of:

a) starting a pump to cause fluid to flow into the elongated tubular member;

b) feeling the junks, as indicated by a drop of weight indicator at the rig floor;

c) washing down the cased hole;

d) reaming down the cased hole;

e) back reaming the cased hole; or f) pulling back the tool while the pump is operative;

g) flushing junks into the inner space of the elongated generally cylindrical body member provided for reception of objects; and h) repeating steps b) through g) until the high angle section is free of obstruction.

The apertures in the elongated tubular member are jet nozzles.

BRIEF DESCRIPTION OF THE DRAWINGS

FIG. 1 is a front elevational view of a tool for recovering debris from a wellbore, constructed according to the present invention;

FIG. 2 is a bottom perspective view of the tool of FIG. 1, illustrating the multiple-section gate at the lowermost end of the main body of the tool;

FIG. 5 is a partial cross-sectional view, taken along lines 5-5 of FIG. 3, illustrating the multi-section spring biased gate intended for passage and ultimate trapping of debris;

DETAILED DESCRIPTION OF THE INVENTION

Figure 3:
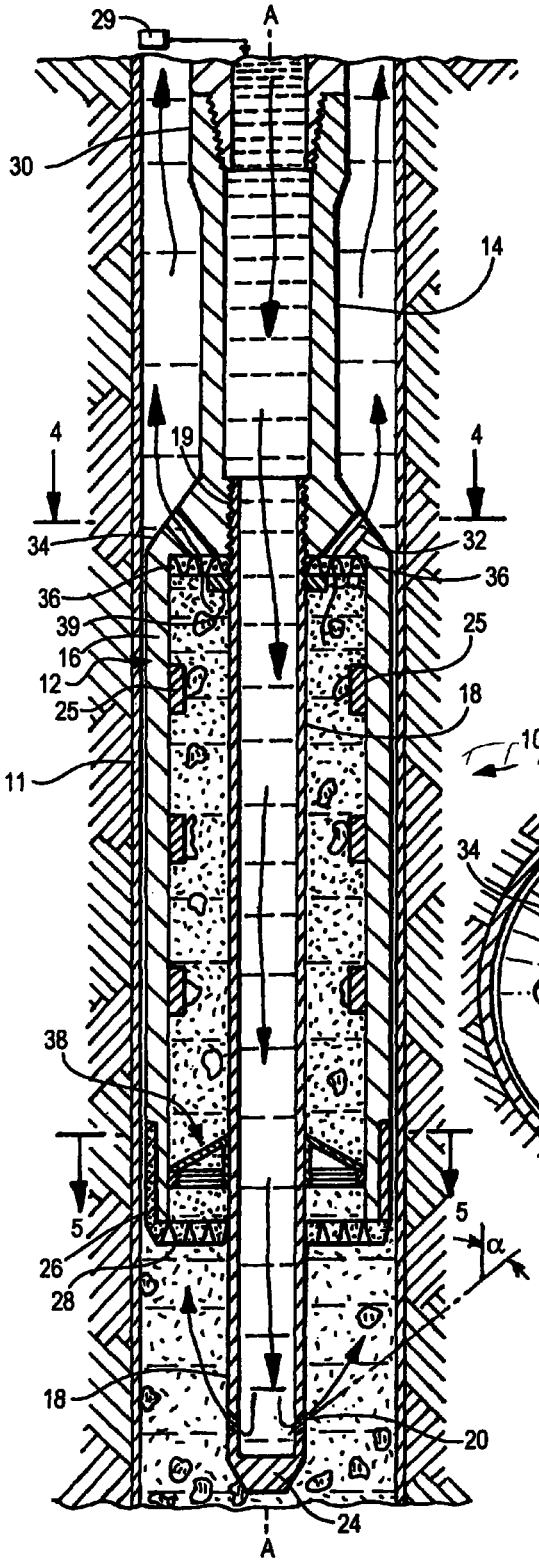
FIG. 3 is an elevational cross-sectional view of the tool shown in FIG. 1, illustrating the passage of unwanted debris upwardly through the tool for collection for ultimately discarding same.
Figure 4:
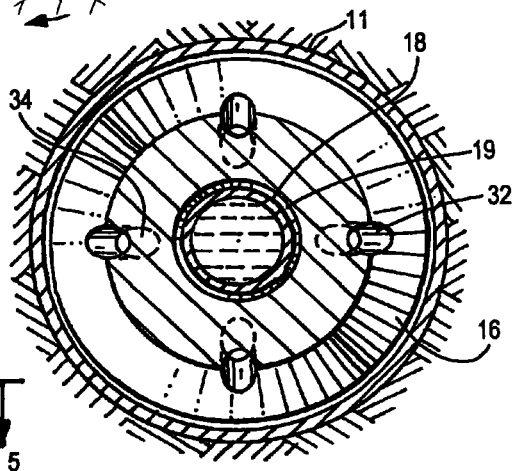
FIG. 4 is a cross-sectional view, taken along lines 4-4 of FIG. 3, illustrating the jet nozzles used for passage and upward diversion of the circulating liquid.

The tool 10 shown in FIGS. 1 and 2 is positioned inside casing 11 and is made of an outer longitudinal body 12 comprised of a drill pipe short upper tubular section 14 and a lower tubular section 16 of diameter greater than that of the upper section 14, with an inner tubular member 18 positioned inside the lower tubular section 16 and extending below the lowermost end of lower section 16, sometimes referred to herein as a "Junk Barrel.". The outer body 12 is a solid piece unitary casing preferably made of P-110 high grade and heavy wall material, with an outer diameter (i.e., O.D.) matching the full drift of the intended casing cleanout application. For instance, if a 7 inch, 26 lbs/ft weight casing is in place, the designed maximum outer diameter (O.D.) is preferably about 6.151 inches. The body length with maximum O.D. is preferably about 6 feet, typically as an effective casing drift tool.

The inner tubular member 18 is made of typical Oil Country Tubular Goods (i.e., OCTG) tubing, for instance in the above referenced tool size. Preferably, inner tubular member 18 is 2⅜ inch tubing (e.g., the outer diameter is 2⅜ inches) for delivering sufficient hydraulic power (or flushing liquid) from pump 29 to the closed lower end of the tubular member 18, where it is equipped with at least three (i.e., 3) upward and radially outward facing jet nozzles 20 to directly flush junks toward the junk barrel 16 as shown in FIG. 3. This inner tube 18 is attached to the outer body 12 by a threaded connection 19 inside the tapered transition zone between the lower tubular section 16 and the upper tubular section 14. The inner tubular member 18 is also extended out of the lower end of the main outer body 12 by an appropriate length as shown in FIGS. 1 and 3, to allow adequate jetting power to facilitate the trapping of the junks by flushing action. For example, in the case of cleaning a 7 inch casing, this extended length may be approximately 2 feet. The lowermost, or "front" tip of the inner tube is a bull nose plug 24, which blocks the flow and diverts it upwardly, causing it to flow through the jet nozzles 20, which produces a direct flushing force to agitate the junks and force the junk loaded fluids into the junk barrel 16. The upward-and radially outward facing jet nozzles 20 can be dimensioned according to the pre-planned jetting pressure requirement by changing the nozzle sizes (e.g., from 12/32 inches to 24/32 inches). In addition, the angle "α" which defines the jet-nozzle direction may be approximately 30 degrees (i.e., 30°) as measured from along longitudinal axis A-A of the inner tube member 18 so that jetting fluid is directed upward and radially outwardly so as to agitate any junk or debris in front of the main body 12 of the tool 10, and to thereby flush them toward the junk barrel 16. In the event a junk is too large to pass through one or more sections of the gate 38, it is likely to be pushed downhole by the force delivered by the work string from the surface.

The annular space between the inner tubular member 18 and the lower section 16 of outer body 12 houses the junk barrel 16, which is designed to be sufficiently spacious to accommodate large pieces of junk as well as small pieces of junk or debris. For instance, if the casing to be cleaned has a 7 inch inner diameter and is 26 lbs/ft in weight, the outer body 16 of the tool must be about 6.151 inch outer diameter (i.e., O.D.) and about 5.375 inch internal diameter (i.e., I.D.), and the inner tubular member 18 will be about 2.375 inch outer diameter (i.e., O.D.). In this example, the room for junk collection is designed to accommodate individual junk sizes up to about 1.5 inches in diameter for round type objects, or more than 1.5 inches in length, but less than 1.5 inches in width for splinter type objects. Several individual magnets 25 can be attached to the inner wall of the lower section 16 of the outer body 12 to attract and retain sizable magnetically attractive metal junks to prevent them from further movement inside the barrel.

Figure 6:
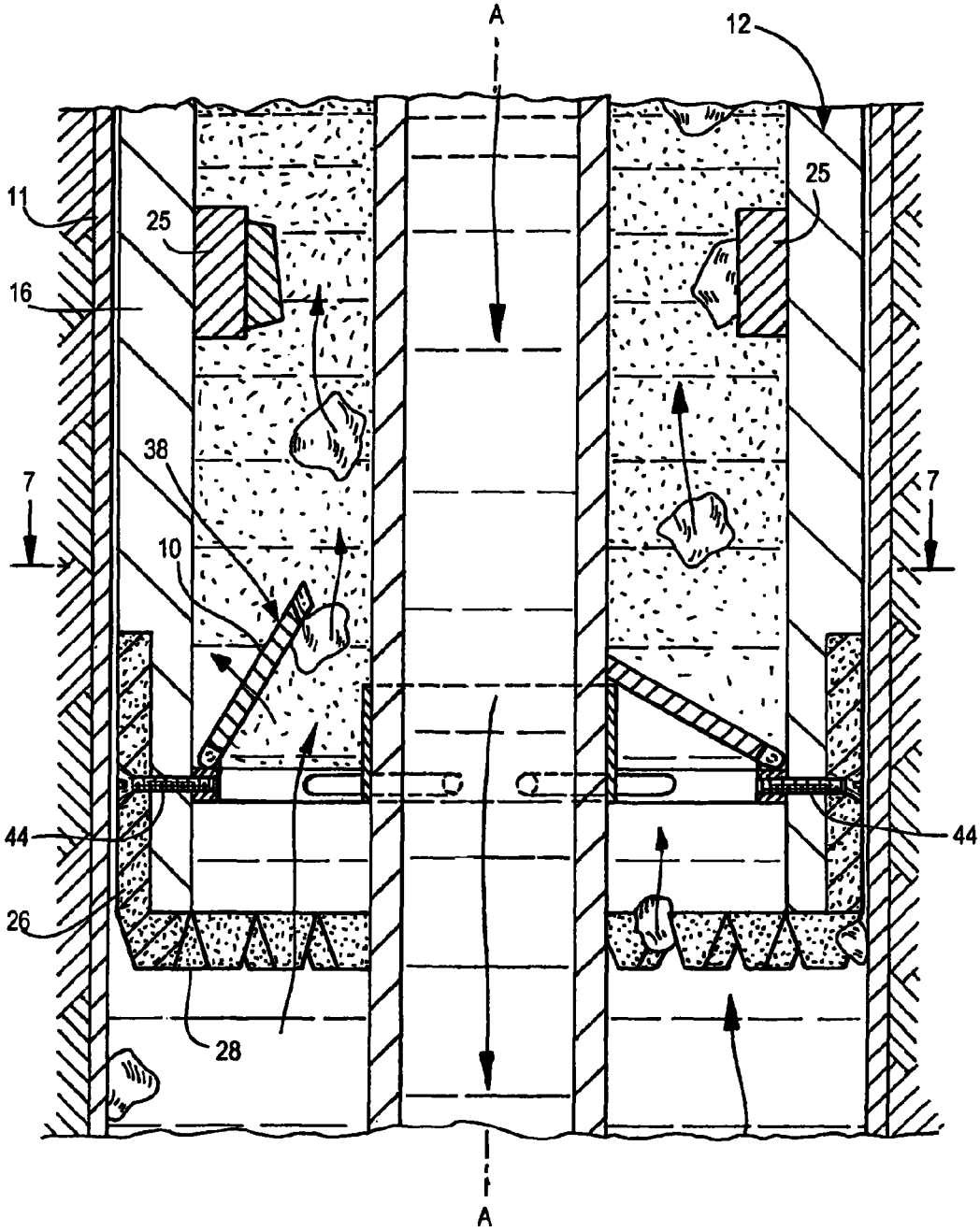
FIG. 6 is an enlarged cross-sectional view of the lower portion of the tool, illustrating the passage of debris past the spring biased gate sections.
Figure 7:
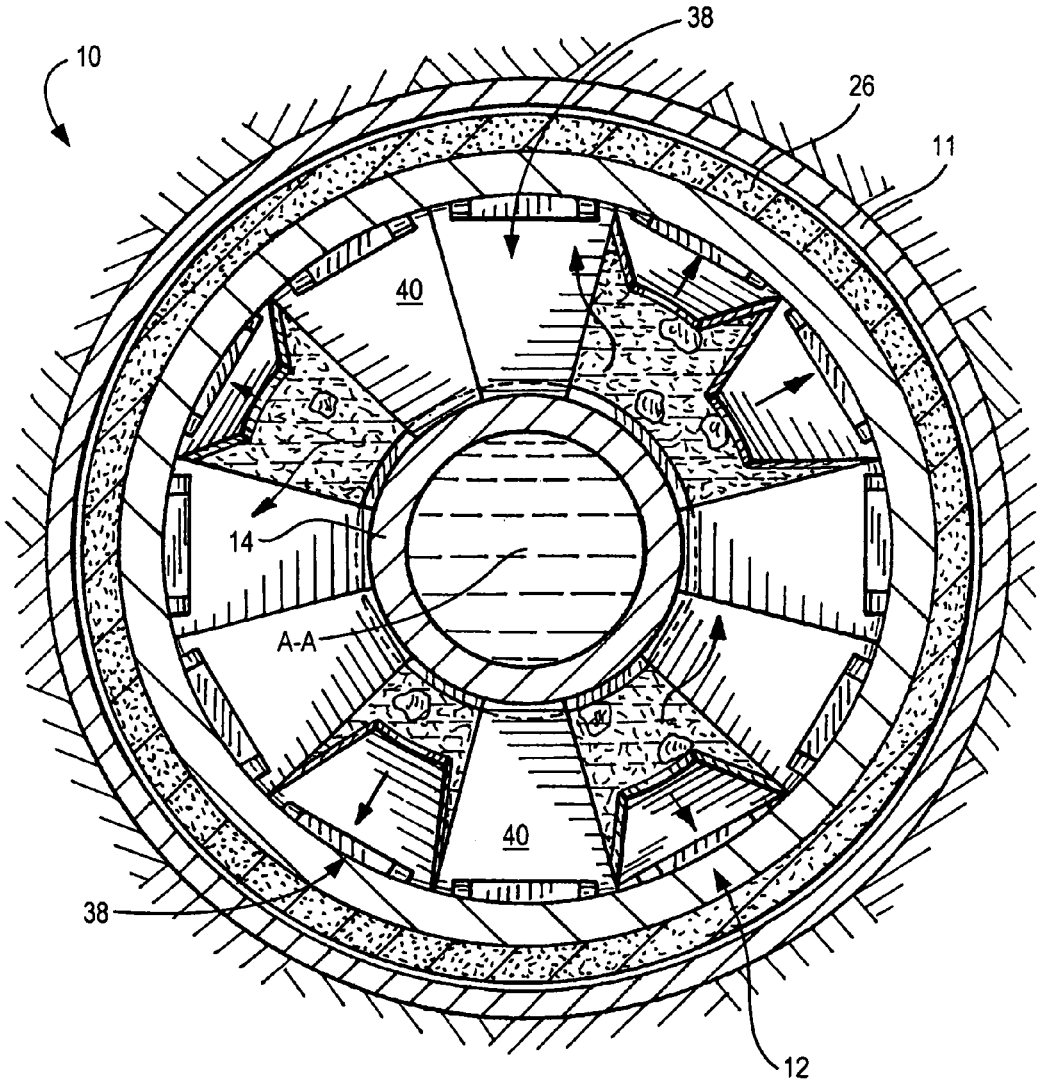
FIG. 7 is a partial cross-sectional view, taken along lines 7-7 of FIG. 6, illustrating the operational features of the multi-section spring biased gate.
Figure 8:
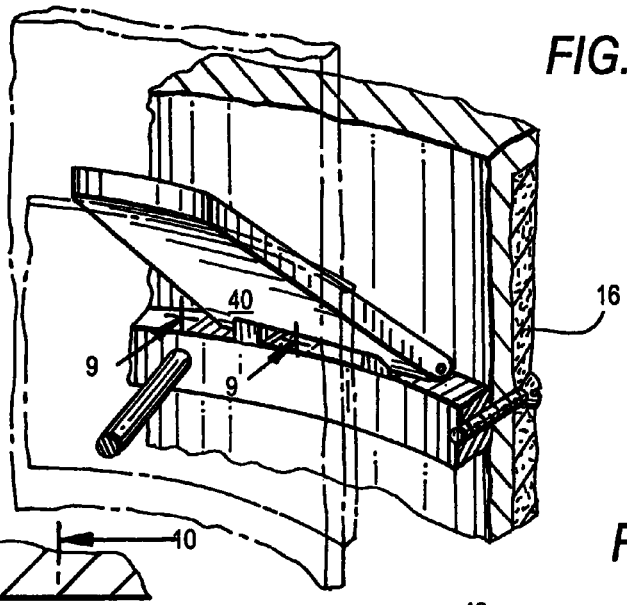
FIG. 8 is an enlarged fragmentary perspective view, illustrating the operative features of a typical one of the spring biased sections of the multi-section gate shown in the previous FIGS.
Figure 9:
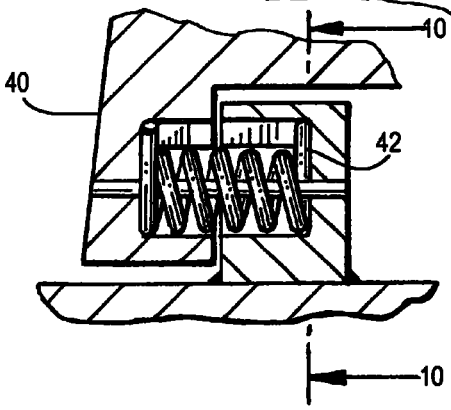
FIG. 9 is a partial cross-sectional view, taken along lines 9-9 of FIG. 8, illustrating the spring arrangement for biasing each typical section of the gate toward the closed position.
Figure 10:
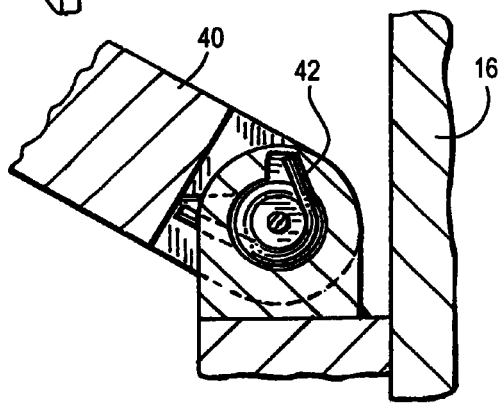
FIG. 10 is a partial cross-sectional view, taken along lines 10-10 of FIG. 9.
Figure 11:
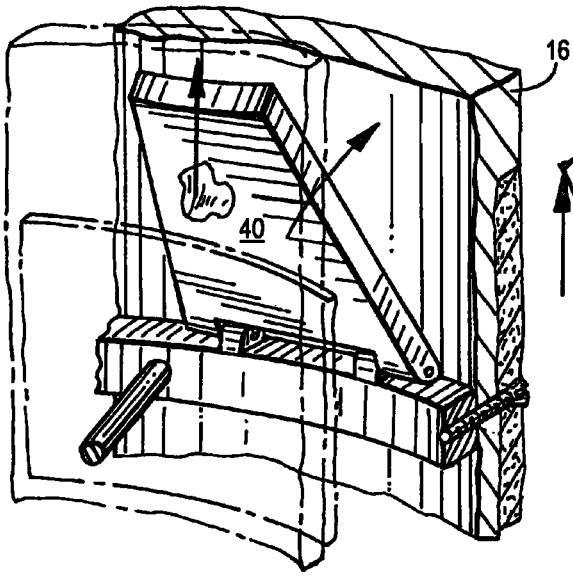
FIG. 11 is an enlarged, fragmentary perspective view of a gate section, similar to FIG. 8, illustrating the passage of flushing liquid and debris thereby, causing the section of the gate to be raised against the force of the spring to permit passage thereby of the flushing liquid and debris.
Figure 12:
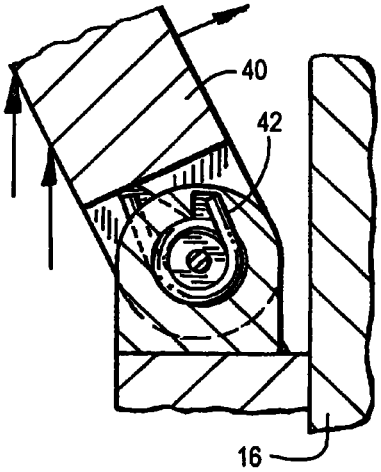
FIG. 12 is a side elevational, partial cross-sectional view, of the section of the gate shown in FIG. 11, which is in the raised position caused by the flushing liquid and debris passing thereby.

The lowermost end of the outer body 12 is provided with fine tungsten carbide cutters 26 on the outer side, and coarse tungsten carbide cutters 28 on the tip. The fine cutters on the outside of outer body 12 may be continuously circumferential, as shown in FIGS. 6 and 7, or spaced apart from each other. These cutters are primarily designed to protect the outer body 12 of the tool 10 from becoming scraped or scarred due to potential hard metal junk or debris in the hole. It is a common misconception that these types of cutters on wellbore cleanout tools are capable of breaking up large pieces of metal junks, since many field experiences indicate that it is rather rare to observe freshly broken up pieces of metals from the collected junks, even though a taper mill is typically used at the bottom of the tool string. Moreover, it is also difficult to grind metal junks to pieces where junks have room or freedom to move alongside the wellbore, unlike the situation at the bottom of a hole where junks cannot escape under milling action.

At the upper end portion of the outer body 12, the outer surface has a taper 33 in the transition portion to the typical drill pipe short upper section 14 with a box connection 30. The tapered design is intended to ensure easy re-entry into the casing shoe during pulling back if the tool 10 is inserted into an openhole, either intentionally or unintentionally.

One example of a box connection is disclosed in US Patent Publication No. US2006/0071474, the disclosure of which is incorporated herein by reference and made a part of this disclosure.

Figure 13:
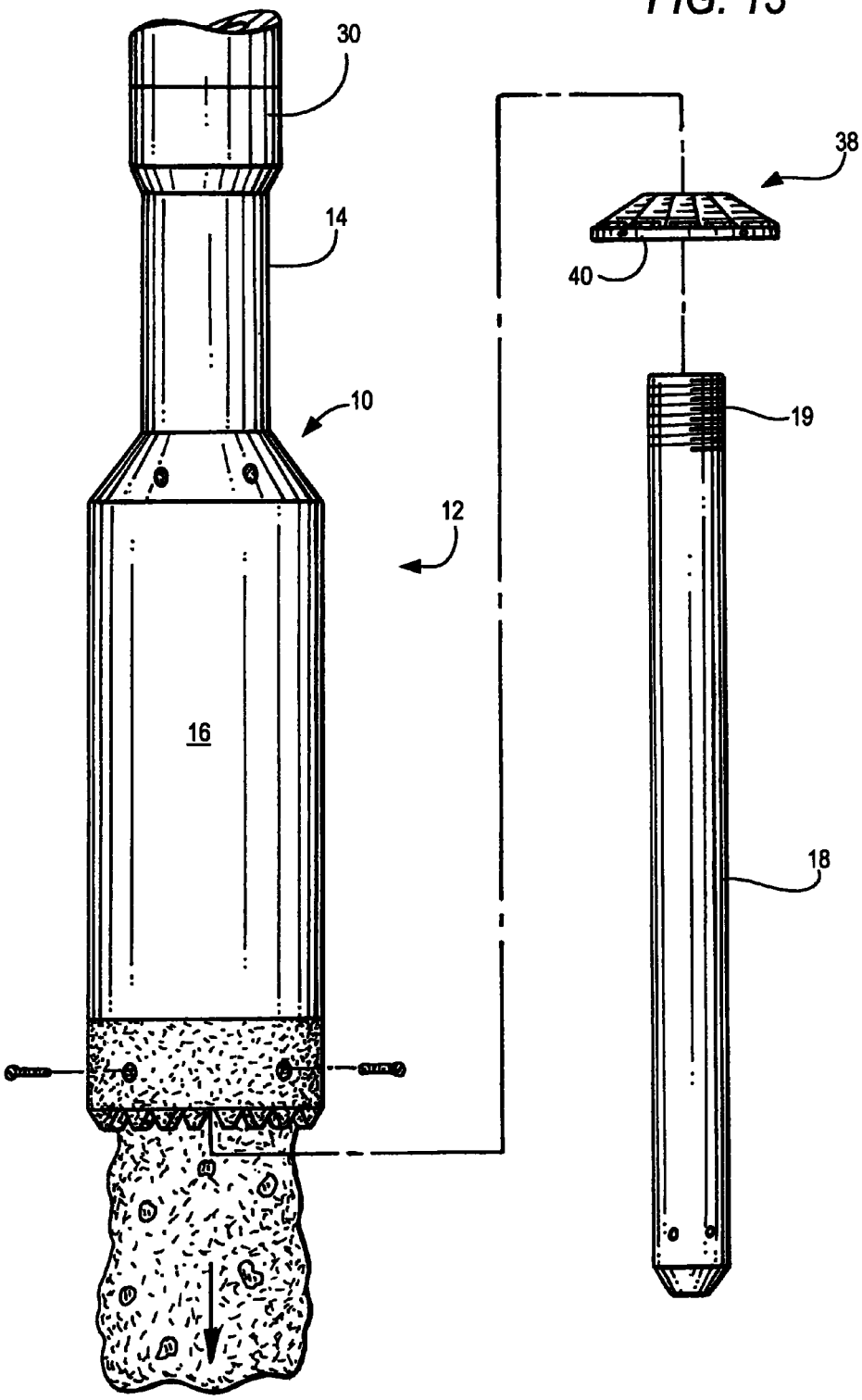
FIG. 13 is an enlarged view, with parts separated for illustrative convenience, showing the tool of the previous FIGS., with the entire multi-section gate separated therefrom to facilitate cleaning the tool of any accumulated and unwanted debris.

Four sizable ¾ inch return flow open ports 32 and 34 are incorporated at the transition between upper tubular section 14 and lower tubular section 16. A filter screen 36 is also incorporated internally immediately in front of open ports 32 and 34, to present any junk objects larger than the screen size to pass therethrough, so that they will be retained in the junk barrel 16 (i.e., tubular section). The filter screen 36 is kept in place or prevented from falling out by a stop ring 39, which is fastened onto the inner tube 18 at the bottom of the screen 36. Both the inner tube 18 and filter screen 36 can be easily removed and changed at the rig site as shown in FIG. 13, by disassembling the entire tool. The filter screen size can be selected on the basis of the wellbore cleanness requirement, i.e., size of junk or debris that is intended to be removed from the wellbore.

At the lowermost end of the junk barrel 16 is a junk entry gate 38, made of a plurality of inclined doors 40, each door being biased by a coil spring 42, to render each door as a spring-loaded flapper valve to allow it to close as a gate, and to retain junk objects once they travel inside the junk barrel 16. Any resilient device for applying a bias force to each section is also contemplated. The multiple-section door design is preferred since it allows either smaller or larger pieces of junk to pass through. For example, a small piece of junk may pass by one door when it opens. However, a larger piece of junk will pass through two or more doors which will open as needed to accommodate the larger piece of junk. The multiple-section flapper valve will open due to fluid pressure from the jet nozzles, and it will close due to its own force of spring 42. This front junk entry gate 38 is fastened to the outer body by screws 44 as best shown in FIG. 6. After a cleanout trip, the entire gate 38 can be removed as shown in FIG. 13, to easily offload all junks including retrieving and replacing magnets 25. The design of the junk gate 38 is preferred over a conventional catcher device of a standard reverse circulating junk basket, where the catcher is made of multiple fingers with small gaps between them. The inclined design of doors 40 also offers additional advantages of keeping the junks inside the junk barrel 16, in case the spring loaded flapper valve fails.

Tool Operational Procedure

The tool 10 of the invention is made as part of the bottom of a wellbore cleanout assembly, and lowered into a wellbore. If any obstruction is encountered for example, across the stage cementing tool of the existing casing, or any possible junk stuck across the casing coupling, such as an API (i.e., American Petroleum Institute) buttress thread where there is a small gap between two adjacent casing joints. The rig pump 29 is started and lightly reamed through the interval, at the same time. The tool is designed to collect debris from the reaming action. After completion of the reaming step, the tool continues to move deeper into the wellbore, slowing down the running speed in the hole when approaching the top of the liner (if existed in the wellbore). Since the tool is expected to encounter resistance in that location due to full body drift diameter of the tool, to enter the liner simply rotate the string or polish the top of the liner first, then rotate the tool into the liner. Subsequently the running "in hole" speed should be reduced to eliminate or reduce pressure surges.

The main task of the tool is expected to occur when reaching a high angle (i.e., greater than 60 degrees) section or "interval", of a cased hole, where metal and other junks or debris are expected to be found. When junks are present at this section of the hole, the tool should "feel" them, as indicated by a drop of weight indicator at the rig floor. At this point, the pump is first started. Next, a combination of the following steps are performed steps:

1) washing down;
2) reaming down
3) back reaming; or
4) pulling back while the pump is on.

Such steps may have to be repeated until the interval is free of any obstruction (i.e., no indication of weight indicator variation as the tool passes the interval with pre-existing junks). At the same time, junks should be flushed into and trapped inside the barrel of the tool. If the junks are far too large to be flushed into the tool, they will be pushed further down into the hole. Thereafter, the operation continues running in the hole to the casing shoe and performs the same steps if any additional junks are encountered, or the remained cased hole is still dirty.

The term "casing shoe" as used herein, is typically a short device that is attached to the very end of the casing string and usually has a tapered shape, with built-in nozzles (i.e., fluid passages) that divert flow at the designed angles for better return flow of cement flurry. The casing shoe is always at the lower end of the casing.

When the junk barrel 16 is full of debris or junks, this will cause the pump pressure to increase rapidly and rise to a level which is substantially more than normal circulating pressure. This condition may indicate that the filter screen in the tool is plugged or partially plugged. Since the annulus between the tool outer body 12 and the casing 11 is relatively small, any flow passing through this annulus would only represent a very small percentage of the total return flow, and therefore would be unlikely to cause major pump pressure changes, even if there is some blockage due to debris. If indeed such blockage is indicated, the extra drag caused by such blockage should be noticed by the driller. If it is determined that the junk barrel 16 is not likely to be full, it is then recommended to work the tool (i.e., pull up and slack off, with and without rotation while keeping the pump on) in an attempt to unblock the filter screen (i.e., as indicated by pump pressure drop). If it is then determined that the junk barrel is full of junks or debris, or if unblocking the filter screen is not successful by this maneuver, it is time to remove the tool from out of the hole and offload the collected junks.

Although this tool is designed to be a cased hole junk catcher, it may not be a problem if the tool is accidentally run into an openhole. The tool is of solid and robust design, and therefore unlike many other wellbore cleanout tools which are not designed to be operated in an openhole. Since the tool body outer diameter may be slightly larger than the bit size used to drill the openhole section, it is desirable to have a prior knowledge that either the openhole is under reamed to a larger size, or hole size is verified by a caliper log, so that this tool can also be used as a drift in the openhole.

As used herein, the term "drift" in respect of oil field terminology generally has two separate meanings. One meaning refers to the internal free pass-through diameter (i.e., "drift") of the casing, and the other refers to a short device having an outer diameter (i.e., "O.D.") that matches the casing drift. This device is typically used to check an internal diameter of a casing by freely passing the device through the casing.

The short device referred to as a "drift", is usually a solid tubular shaped tool with an outer diameter which matches the minimum diameter or "drift". The device is a little smaller than the nominal internal diameter (i.e., "I.D.") of the casing. Both the casing I.D. and drift are specified by the casing manufacturer. Due to the fact that it is virtually impossible to make a casing with perfectly uniform wall thickness (i.e., absolutely constant internal diameter of the casing), there is a certain predetermined variation in casing wall thickness for each casing size that is accepted in the industry (as per API Specification 5CT). However, each manufacturer typically guarantees a drift size for each size casing product.

Several features of the invention are as follows:

1) The preferred embodiments offer a downhole wellbore cleanout tool that is dedicated to repeatedly catch small to medium size junks and debris in a more effective and efficient manner, and at the same time, drift the casing to ensure that the wellbore is indeed clean, hence providing the incentive to reduce rig time.

2) Compared to other existing similar type tools, the preferred embodiments offer the ability to catch relatively bigger size junks.

3) The tool is simple in design, and hence easy to manufacture and mechanically robust, consequently bears much less risk of tool failure even in harsh environment where hard metal junks may be present in a wellbore.

4) The tool is designed to work in total mud loss environment, and hence offers a distinctive advantage compared to current wellbore cleanout tools.

The invention has the potential to become a timely tool, particularly for future well construction process involved with smart completion or expandable liner installation in any wellbore, for which thorough wellbore cleanout is a must requirement.

List of Reference Numbers

10 Tool
11 Casing
12 Outer longitudinal body
14 Upper tubular section
16 Lower tubular section
16 Junk barrel
18 Inner tubular member
19 Threaded connection
20 Upward and outward radially facing jet nozzles
22 Gate
24 Bull nose plug
25 Magnets
26 Small tungsten carbide cutters
28 Coarse tungsten carbide cutters
29 Pump
30 Box connection
32 Return flow open port
33 Taper
34 Return flow open port
36 Filter screen
38 Junk entry gate
39 Stop ring List of Reference Numbers

40 Plurality of inclined doors
42 Coil Spring
44 Screws

I claim:

1. A wellbore cleanout tool for recovering objects and debris from a well having a wellbore hole having a casing which comprises:

a) an elongated generally cylindrical body member having an inner wall surface and dimensioned to be positioned within the casing and defining an inner space for reception of objects to be recovered from the wellbore of the well, said body member having a generally inwardly tapered outer wall portion at an upper end thereof, said tapered outer wall portion having a plurality of upwardly directed apertures extending therethrough which communicate with said inner space;

b) an elongated tubular member defining a generally longitudinal axis, said elongated tubular body member being positioned inside said elongated generally cylindrical body member and attached thereto, said elongated tubular.member extending below a lower end of said generally cylindrical body member, and having a diameter less than an inner diameter of said generally cylindrical body member so as to define an annular space therebetween, said elongated tubular member having a closed lowermost end, and being adapted to receive pressurized flushing liquid at an upper end thereof, said elongated tubular member further having a plurality of generally upwardly extending apertures adjacent said closed lowermost end and extending through a wall portion of said elongated tubular member, said apertures being oriented at a generally acute angle relative to said longitudinal axis, said apertures positioned and oriented for directing the flushing liquid radially outwardly and upwardly of said elongated tubular member toward said annular space between said generally cylindrical body member and said inner elongated tubular member, said flushing liquid having a velocity sufficient to direct objects and debris from the wellbore into said annular space;

c) a multiple-section gate positioned within said elongated generally cylindrical body member and attached to an inner wall surface of said generally cylindrical body member adjacent a lower end portion thereof, each said section of said gate being pivotally mounted and spring biased to pivot inwardly and downwardly toward generally radial closed positions which blocks the lower end of said generally cylindrical body member, each said gate section being capable of upward pivotal movement by force provided by the upward movement of the flushing liquid when exiting said apertures in said elongated tubular member and being directed toward said gate in said generally cylindrical body member; and d) means positioned adjacent said apertures in said tapered wall portion at the upper end of said generally cylindrical body member to filter the upwardly directed liquid to separate debris and other objects therefrom for containment within said generally cylindrical body member prior to the liquid exiting said generally cylindrical body member through said apertures in said upper tapered wall portion of said generally cylindrical body member.

2. The wellbore cleanout tool according to claim 1, wherein a plurality of magnets are positioned inside said elongated generally cylindrical body member to attract magnetically attractable junks.

3. The wellbore cleanout tool according to claim 2, wherein said plurality of magnets are attached to the inner wall surface of said elongated generally cylindrical body member.

4. The wellbore cleanout tool according to claim 3, wherein said generally cylindrical body member has a standard drill pipe short section with a box connection attached to the upper end thereof for attachment to a string of drill pipes.

5. The wellbore cleanout tool according to claim 4, wherein said means to filter the upwardly diverted liquid and objects and debris adjacent said apertures in said tapered wall portion is a screen.

6. The wellbore cleanout tool according to claim 5, wherein said lower end of said elongated tubular body member is a comprised of bull nose plug.

7. The wellbore cleanout tool according to claim 6, wherein the lower end portion of said elongated generally cylindrical body member comprises fine tungsten carbide cutters.

8. The wellbore cleanout tool according to claim 7, wherein each section of said multi-section gate is biased toward said generally radial closed position against the outer surface of said elongated tubular member, and each said section of said gate is oriented at a generally acute angle relative to said generally longitudinal axis.

9. The wellbore cleanout tool according to claim 8, wherein said multi-section gate is removably attached as a unitary member to said elongated generally cylindrical body member by fastener members.

10. The wellbore cleanout tool according to claim 9, wherein said fastener members are screws.

11. The wellbore cleanout tool according to claim 10, wherein each said gate section is biased toward the closed position by a spring.

12. The wellbore cleanout tool according to claim 11, wherein each said spring is a coil spring.

13. The wellbore cleanout tool according to claim 12, wherein said elongated tubular member is threadedly attached to an inner upper portion of said elongated generally cylindrical body member.

14. The wellbore cleanout tool according to claim 6, wherein the lower end portion of said elongated generally cylindrical body member comprises coarse tungsten cutters.

15. The wellbore cleanout tool according to claim 14, wherein each section of said multi-section gate is biased toward said generally radial closed position against the outer surface of said elongated tubular member, and each said section of said gate is oriented at a generally acute angle relative to said generally longitudinal axis.

16. The wellbore cleanout tool according to claim 15, wherein said multi-section gate comprises a unitary member which is removably attached to said elongated generally cylindrical body member by fastener members.

17. The wellbore cleanout tool according to claim 16, wherein said fastener members are screws.

18. The wellbore cleanout tool according to claim 17, wherein each said gate section is biased toward the closed position by a spring.

19. The wellbore cleanout tool according to claim 18, wherein each said spring is a coil spring.

20. The wellbore cleanout tool according to claim 19, wherein said elongated tubular member is threadedly attached to an inner upper portion of said elongated generally cylindrical body member.

21. The wellbore cleanout tool according to claim 1 wherein said upwardly directed apertures in said elongated tubular member comprise jet nozzles configured and dimensioned to increase the velocity of the flushing liquid exiting therefrom, said jet nozzles oriented at approximately 30 degrees relative to said longitudinal axis.

22. A wellbore cleanout tool for recovering objects and debris from a wellbore hole having a casing, which comprises:

a) an elongated generally cylindrical body member having an inner wall surface and defining an inner space for reception of objects to be recovered from a wellbore of the well, said body member having a generally inwardly and upwardly tapered outer wall portion at an upper end thereof, said tapered outer wall portion having a plurality of upwardly directed open ports extending therethrough and communicating with said inner space;

b) an elongated tubular member defining a generally longitudinal axis, said elongated tubular body member being positioned inside said elongated generally cylindrical body member and threadedly attached thereto, said elongated tubular member extending below a lower end of said generally cylindrical body member, and having a diameter less than an inner diameter of said generally cylindrical body member so as to define an annular space therebetween, said elongated tubular member having a plug at the lowermost end to prevent flow thereby, said elongated tubular member being adapted to receive hydraulic power or pressurized circulating flushing liquid at an upper end, said elongated tubular member further having a plurality of generally upwardly extending jet nozzles adjacent said lowermost closed end and extending through a wall portion of said elongated tubular member, said jet nozzles each being oriented at a generally acute angle relative to said longitudinal axis, said nozzles for directing the flushing liquid at relatively higher velocity radially outwardly and upwardly of said elongated tubular member toward said annular space between said generally cylindrical body member and said inner elongated tubular member, to thereby direct objects and debris from the wellbore into said annular space;

c) a multiple-section gate positioned within said elongated generally cylindrical body member and attached to an inner wall surface of said generally cylindrical body member adjacent a lower end thereof, each said section of said gate being biased by a spring device to pivot inwardly and downwardly toward generally radial positions which blocks the lower end of said generally cylindrical body member, each said gate section being capable of upward pivotal movement by force provided by the upward movement of the flushing liquid when exiting said jet nozzles in said elongated tubular member and being directed toward said gate in said generally cylindrical body member;

d) means positioned adjacent said open ports in said tapered wall portion at the upper end of said generally cylindrical body member to filter the upwardly directed liquid to separate debris and other objects therefrom prior to the liquid exiting said generally cylindrical body member through said apertures in said upper tapered wall portion of said generally cylindrical body member; and e) a plurality of magnets attached to the inner surface of said elongated generally cylindrical body member to attract magnetically attractable objects and debris.

23. The wellbore cleanout tool according to claim 22, wherein said generally cylindrical body member has a standard drill pipe short section with a box connection attached to an upper end thereof for attachment to a string of drill pipes.

24. The wellbore cleanout tool according to claim 23, wherein said means to filter the upwardly diverted liquid and objects and debris adjacent said open ports in said tapered wall portion is a screen.

25. The wellbore cleanout tool according to claim 24, wherein the lower end portion of said elongated generally cylindrical body member comprises fine tungsten carbide cutters.

26. The wellbore cleanout tool according to claim 24, wherein the lower end portion of said elongated generally cylindrical body member comprises coarse tungsten cutters.

27. A method of removing junks or debris from a high angle section of a cased hole of a wellbore of a well utilizing a wellbore cleanout tool for recovering objects and debris from the wellbore operative from a rig having a floor, said cleanout tool comprising an elongated generally cylindrical body member which defines an inner space for reception of objects to be recovered from a wellbore of the well, said generally cylindrical body member having a generally inwardly tapered outer wall portion at the upper end thereof, said tapered outer wall portion having a plurality of upwardly directed apertures extending therethrough, an elongated tubular member defining a generally longitudinal axis, said elongated tubular body member being positioned inside said elongated generally cylindrical body member and attached thereto, said elongated tubular member extending below a lowermost closed end of said generally cylindrical body member, and having a diameter less than an inner diameter of said generally cylindrical body member so as to define an annular space therebetween, said elongated tubular member having a closed lowermost end, and being adapted to receive pressurized flushing liquid at an upper end, said elongated tubular member further having a plurality of generally upwardly extending apertures adjacent said lowermost closed end and extending through a wall of said tubular member, said apertures being oriented at a generally acute angle relative to said longitudinal axis, said apertures for directing the flushing liquid radially outwardly and upwardly of said elongated tubular member toward said annular space between said generally cylindrical body member and said inner elongated tubular member, to thereby direct objects and debris from the wellbore into said annular space, a multiple-section gate positioned within said elongated generally cylindrical body member and attached to an inner wall of said generally cylindrical body member adjacent the lower end thereof, each said section of said gate being spring biased to pivot inwardly and downwardly toward generally radial positions which blocks the lower end of said generally cylindrical body member, each said gate section being capable of upward pivotal movement by force provided by the upward movement of the flushing liquid when exiting said apertures in said elongated tubular member and being directed toward said gate in said generally cylindrical body member, and means positioned adjacent said apertures in said tapered wall portion at the upper end of said generally cylindrical body member to filter the upwardly directed liquid to separate debris and other objects therefrom prior to the liquid exiting said generally cylindrical body member through said apertures in said upper tapered wall portion of said generally cylindrical body member, said method comprising the steps of:

a) starting a pump to cause fluid to flow into said elongated tubular member;

b) feeling the junks, as indicated by a drop of weight indicator at the rig floor;

c) washing down the cased hole;

d) reaming down the cased hole;

e) back reaming the cased hole; or f) pulling back said tool while the pump is operative;

g) flushing junks into said inner space of said elongated generally cylindrical body member provided for reception of objects; and h) repeating steps b) through g) until the high angle section is free of obstruction.

28. The method according to claim 27, wherein said apertures in said elongated tubular member comprise jet nozzles.

* * * * *